US005720228A

United States Patent [19]

Clive-Smith

[11] Patent Number: 5,720,228

[45] Date of Patent: Feb. 24, 1998

[54] FOLDING FLATRACK

[76] Inventor: Martin Clive-Smith, 66 Leam Terrace, Leamington Spa, Warwickshire, CV31 1BQ, United Kingdom

[21] Appl. No.: 760,813

[22] Filed: Dec. 5, 1996

Related U.S. Application Data

[63] Continuation of Ser. No. 370,450, Jan. 9, 1995, abandoned.

[30] Foreign Application Priority Data

Jan. 11, 1994 [GB] United Kingdom ..... 9400395
Mar. 24, 1994 [GB] United Kingdom ..... 9405882

[51] Int. Cl.[6] ..... B65D 19/38
[52] U.S. Cl. ..... 108/55.1
[58] Field of Search ..... 108/55.1, 51.1, 108/55.3, 55.5, 56.1

[56] References Cited

U.S. PATENT DOCUMENTS

| | | | |
|---|---|---|---|
| 1,349,500 | 8/1920 | Dietz | 108/55.1 X |
| 2,936,985 | 5/1960 | Doerr et al. | 108/55.1 |
| 2,956,763 | 10/1960 | D'Arca | 108/55.1 X |
| 3,219,252 | 11/1965 | Fleming et al. | 108/55.1 X |
| 3,620,388 | 11/1971 | Mansson | 108/55.1 X |
| 3,762,343 | 10/1973 | Thacker | 108/55.1 X |
| 4,319,732 | 3/1982 | Godfrey | 108/55.1 X |
| 4,353,520 | 10/1982 | Jansson | 108/55.1 X |
| 4,638,744 | 1/1987 | Clive-Smith | 108/55.1 X |
| 4,964,349 | 10/1990 | Bishop | 108/51.1 X |

*Primary Examiner*—Jose V. Chen
*Attorney, Agent, or Firm*—Oppenheimer Poms Smith

[57] ABSTRACT

A folding flatrack freight carrier has folding walls (111) comprising slender corner posts (112) of a width similar to the conventional lashing gap (L). The posts (112) are synergetically supported by the wall structure (111) which may be transversely corrugated (113) or may have transverse or other stiffeners (127) secured to it. The slender corner posts (112) may comprise solid bars, rolled or pressed angle sections (129) or channel sections (138,139). The wall structure (113) may be extended angularly at (140) to form a hollow box section (141) with the slender corner post (112). The flatrack based platform may be made of an extended width (E) compared with the basic width (B) of a conventional flatrack, whilst still accommodating the corner posts (112) alongside the side rails (118) in the folded condition.

25 Claims, 4 Drawing Sheets

Figure 1:
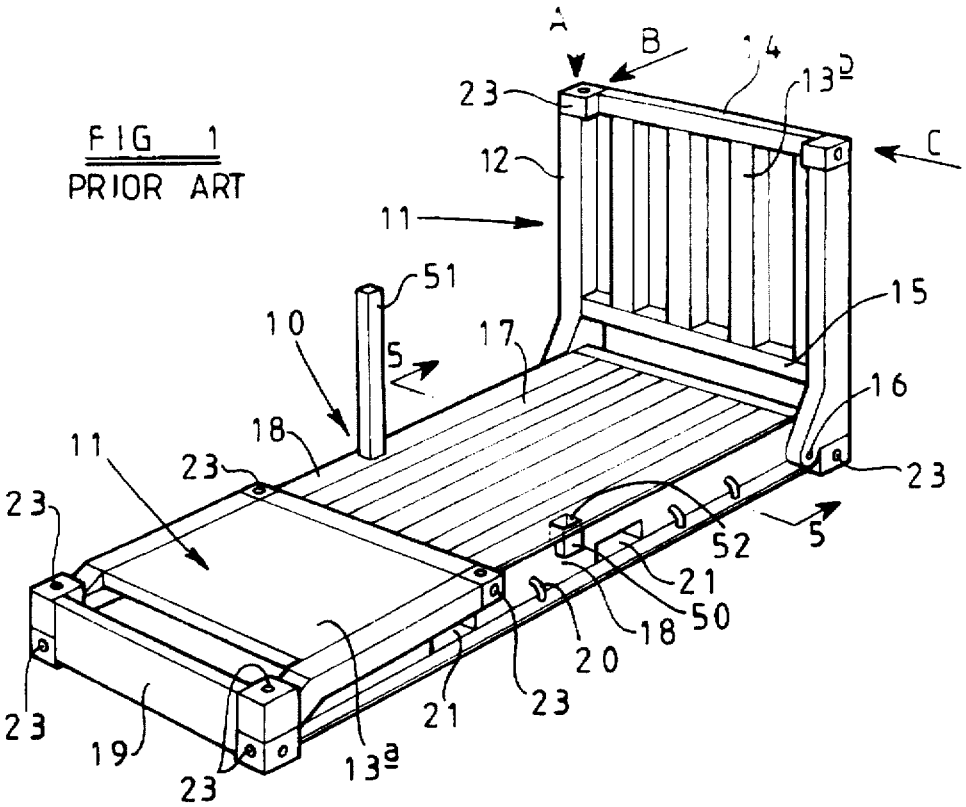
FIG 1 PRIOR ART

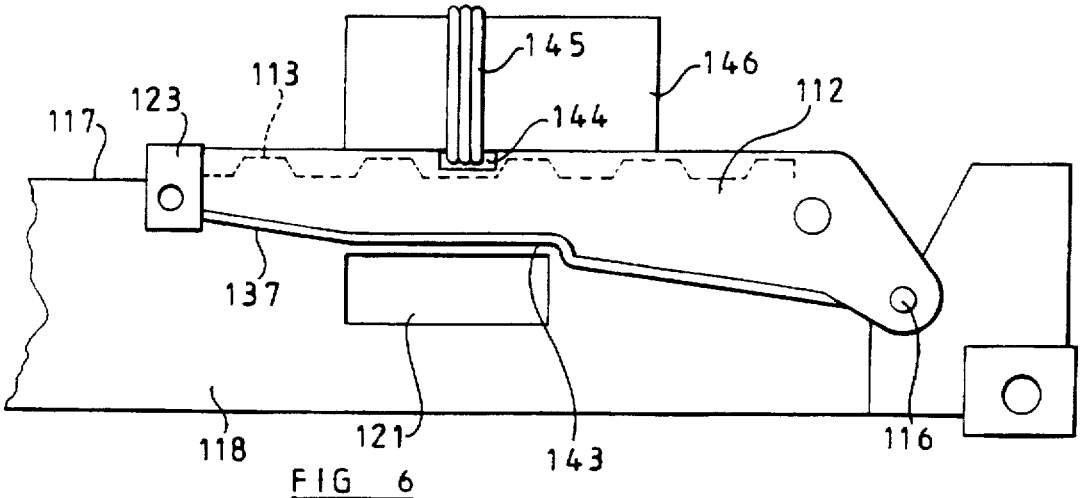
FIG 6
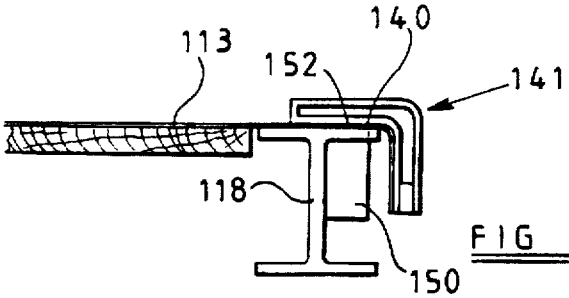
FIG 7
FIG 8
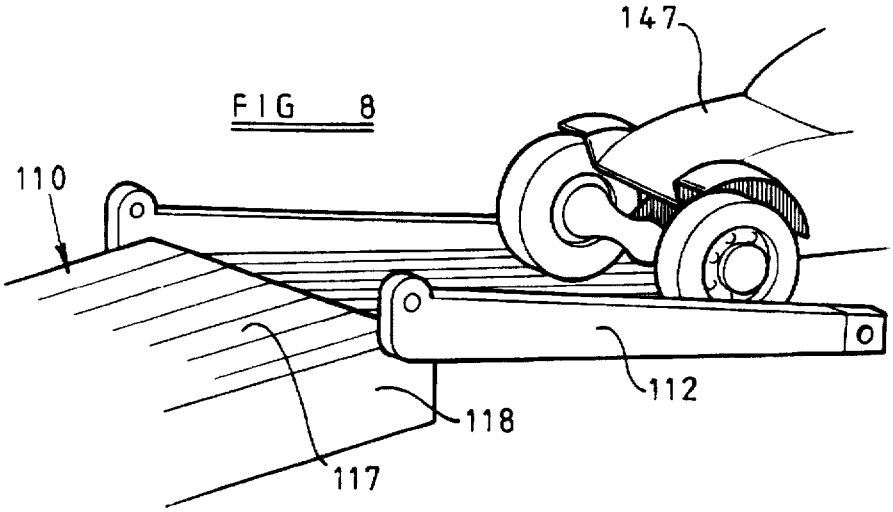

FOLDING FLATRACK

This application is a continuation of now abandoned application, Ser. No. 08/370,450, filed Jan. 9, 1995 now abandoned.

This invention relates to freight containers of the type known as flatracks in which a platform base is provided with foldable walls (usually end walls) which can fold down onto the platform base so that the empty flatrack can be stacked with similar flatracks in a compact fashion, to reduce bulk and freight costs.

The walls of the flatrack are preferably also capable of carrying a load when so folded down.

A conventional flatrack usually has walls which comprise stout corner posts joined by a sheet metal panel which is conventionally of flat metal. The posts fold down alongside the platform base and the sheet metal panel lies on the deck of the platform. This means that any load superimposed on it is transmitted directly onto the platform and so the sheet metal panel is not excessively loaded. It has also been proposed to use a corrugated metal panel having horizontally running corrugations which therefore extend laterally of the platform when the wall is folded down. In this case, the load can rest on the corrugations of the wall at one side, the corrugations at the other side resting on the platform to transmit the load.

It will be appreciated that the posts have to be very sturdy because of the extreme forces to which they are subjected during transportation and handling of the container when loaded. The loads may be directed vertically downwardly, for example when a number of loaded freight containers are stacked one on another. They may also be .exerted longitudinally of the freight container, for example when a loaded container on a train is subject to sudden braking or acceleration during shunting. Additionally, during the course of normal handling, the posts may be subjected to side loads, for example when containers are being manoeuvred into side-by-side condition in a freight yard.

Conventional flatracks have a disadvantage that the width of the platform has been restricted, at least at the end regions where the walls fold onto the platform, because of the thickness of these conventional stout corner posts. The platform has to be narrowed so that the corner posts can fold down and lie alongside the edges of the platform with the panel resting on the platform, leaving the flatrack of a basic width which is approximately 150–400 mm less than the total overall width of a standard freight container. In addition to providing sufficient width for the posts to fold down alongside the platform base, it is necessary also to provide sufficient width for lashings to be made to secure the cargo to the flatrack when it is used as a freight carrying platform, with the walls upright.

As used in this specification, the expression "basic width" should be understood as applying to the basic width of the platform base of a conventional flatrack in which the overall freight container dimensions are reduced by a sufficient amount to allow both for the posts to be folded down alongside the platform base and for the lashings to be routed outside the platform base.

While the reduction of width of the freight container to the basic width may not cause problems in some instances, it can seriously decrease the load carrying capacity, for example for sacks and bales of material which need to be supported right out to their edges so as not to overhang the platform base. In these circumstances, it would be very desirable to have a flatrack having an extended width platform base.

The expression "extended width" means a width equal to the overall standard freight container width reduced only by a sufficient amount to allow for a lashing gap. In a typical example, the lashing gap width may be 15–40 mm although the advantages of the invention may be gained even for a larger gap.

It has hitherto proved to be impossible for a flatrack to be constructed having an extended base width (as defined) because of the width of the posts which need to be designed to support the massive loads imposed on them.

It is therefore an object of the present invention to provide a folding flatrack in which an extended width base can be provided without loss of structural integrity of the walls.

According to the invention there is provided a folding flatrack comprising an elongate platform base and at least one wall adapted to fold onto the base from an upright position, the wall comprising a pair of posts and wall structure connecting the posts and extending transversely across the platform, characterised in that the posts are slender considered transversely of the platform so as to have a transverse dimension capable of lying within a conventional lashing gap, the wall structure being rigidly secured to the posts to support them against vertical and lateral buckling under loading when the folding wall is upright.

The posts may have a nominal transverse dimension of 100 mm or less and preferably between 15 and 40 mm.

The posts and wall structure combine synergetically to retain the structural integrity of the wall.

The wall structure may further be characterised by comprising a metal sheet having stiffeners effective against loading applied transversely of the platform and optionally also against vertical loading.

The stiffeners may be integrally formed in the metal sheet or may be rigidly secured to the metal sheet.

The slender posts may have a rectangular cross-section. The rectangular cross-section may have an additional stiffening section at the free edge remote from the wall structure. Alternatively, the slender posts may be of angle cross-section having a limb aligned with the general plane of the wall structure and secured thereto.

As a further alternative the slender posts may be of asymmetrical channel section having a short limb secured at right-angles to the general plane of the wall structure.

The posts may each comprise a sheet metal pressing. Alternatively they may each comprise a rolled steel section.

The posts may taper from the hinge end to the free end.

The posts may be apertured at one or more positions within their length or may have one or both edges non-linear.

The wall structure may have generally right-angled edge extensions which may be secured side-by-side to the posts. The wall structure edge extensions may be secured parallel to form a hollow tubular structure with each post or may be secured side-by-side as a laminate with the post.

In an alternative embodiment, the posts themselves may be tubular. The folding wall may be arranged to fold outboard of the container base to form a loading ramp. In an alternative form, the wall structure may comprise one or more transverse structures such as beams.

Figures 2A, 2B:
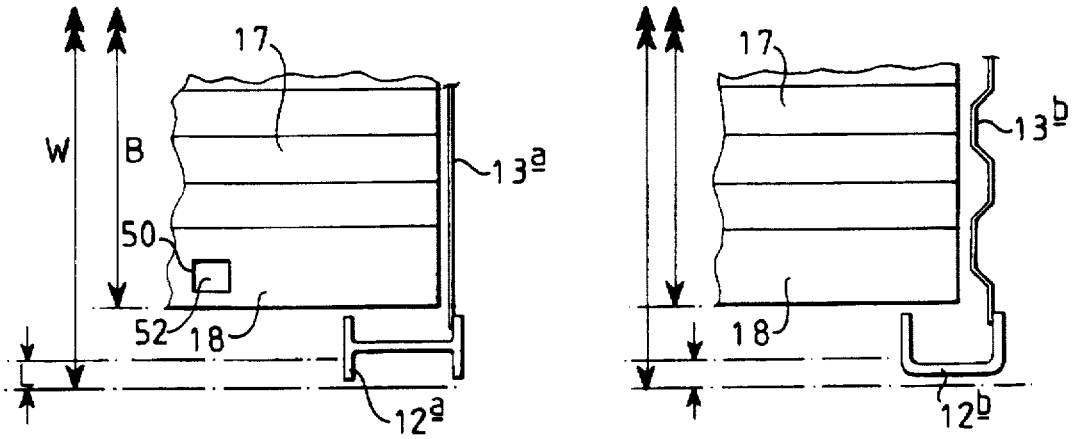
FIG 2A PRIOR ART FIG 2B
Figure 3:
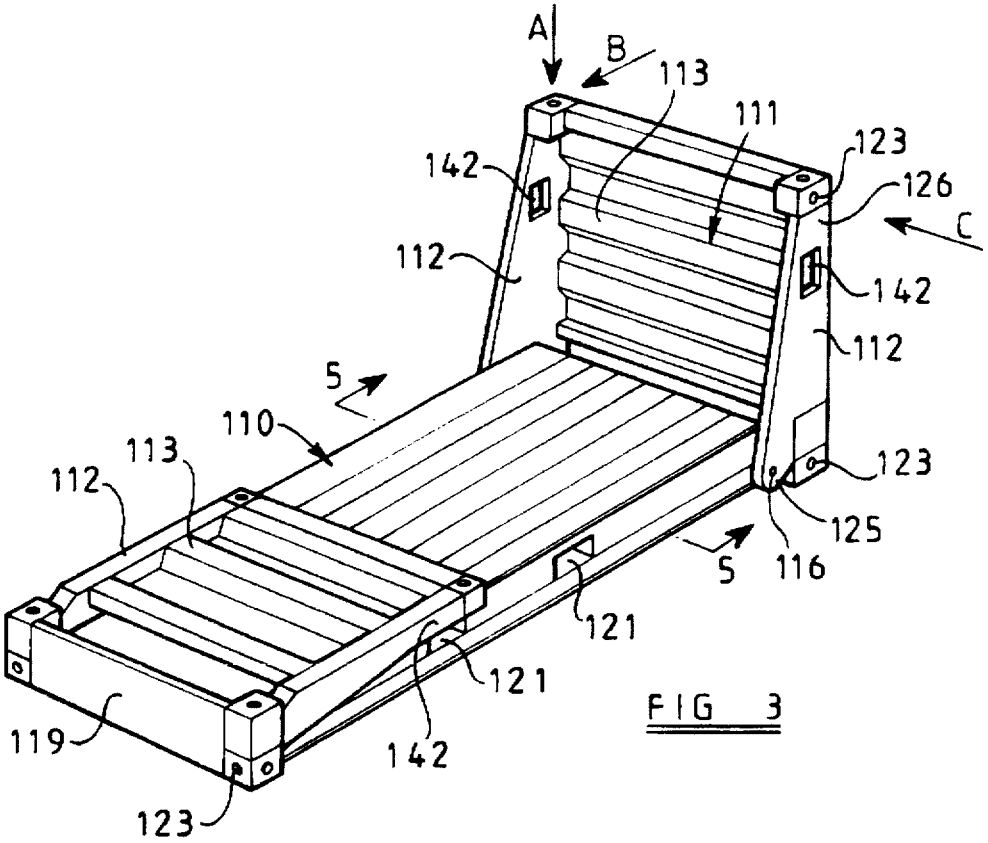
Figure 5:
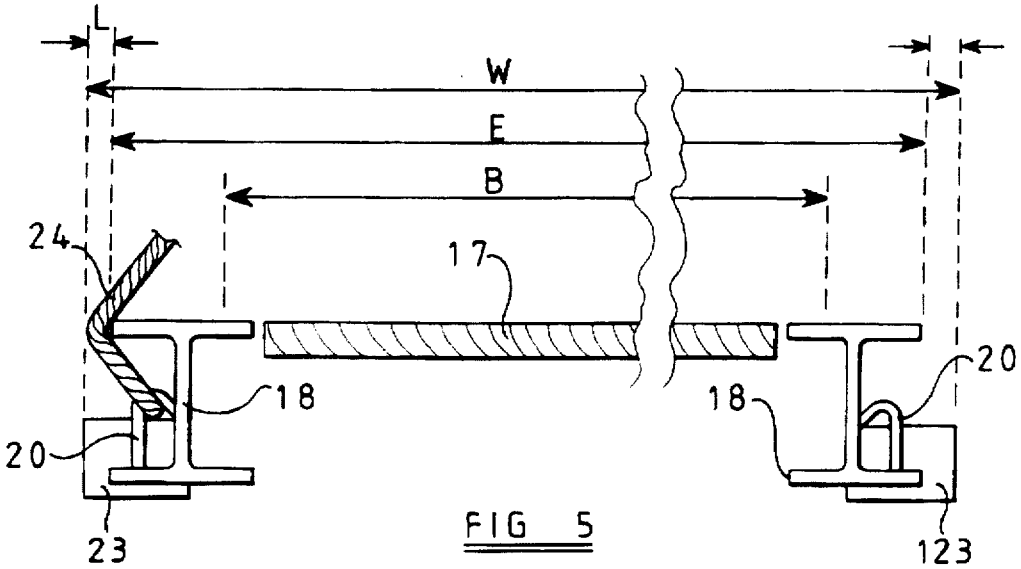

Various embodiments of the invention will now be described in more detail by way of example only with reference to the accompanying drawings in which, FIG. 1 illustrates a prior art flatrack of which the left-hand end illustrates a folded wall and the right-hand end illustrates an upright wall, FIG. 2*a* and FIG. 2*b* illustrate prior art side posts in plan section, FIG. 3 is a view similar to that of FIG. 1 showing a flatrack embodying the invention, FIGS. 4*a* to 4*f* are plan sectional views of slender side posts embodying the invention, similar to the views of FIGS. 2*a* and 2*b*, FIG. 5 is based on a sectional view on the line 5—5 of FIG. 1 or FIG. 4 illustrating the concept of basic width and extended width, FIG. 6 is a side elevational view of a slender post embodying the invention and illustrating further modifications, the post being shown in the folded condition of the wall, FIG. 7 is a transverse scrap section of an alternative form of post in the folded condition of the wall, FIG. 8 is a diagrammatic perspective view of a ramp end flatrack embodying the invention.

With reference to FIGS. 1 and 2 of the drawings, which show prior art, the flatrack comprises a platform base 10 which is of elongate rectangular form in plan view and a pair of foldable walls 11 shown at each end. The walls could however be spaced from the ends of the platform. Each wall 11 comprises a pair of posts 12 and platform structure 13 in the form of a sheet metal panel disposed between the posts 12. Top and bottom rails 14 and 15 are also provided. The foldable wall is pivotable about a pivot 16 from the upright condition shown at the right-hand end of FIG. 1 to a folded condition shown at the left-hand end of FIG. 1. In this folded condition, the panel 13 lies flat on the timber deck 17 of the platform 10. The sides of the platform are defined by rigid I-beams 18 and end sills 19 are also provided.

For handling purposes, corner fittings 23 are provided at the upper ends of each of the posts 12, at each corner of the platform so as to be accessible from below and also so as to be accessible from above when the wall 11 is folded down. The use of such corner fittings is well known.

The side rails 18 are provided with welded on loops 20 to receive lashings to secure freight in position.

Additionally, transverse openings 21 are provided to receive the forks of a fork lift truck in order to lift the flatrack.

The panel 13 may either comprise a planar metal sheet as shown at the left-hand end of FIG. 1, which rests flush with the deck 17 of the platform base and which can carry point loads when the wall is in the folded down condition; or the wall panel 13 may be corrugated vertically as shown at the right-hand end of FIG. 1, in which case it is more suitable for use with distributed loads when folded down.

FIGS. 2*a* and 2*b* are detail plan sectional views of a corner of a conventional flatrack such as that shown in FIG. 1. These views illustrate generally the features which have been described above. A corner of the platform decking 17 is shown, together with a small portion of the side rail 18. A corner post is illustrated in section at 12*a* or 12*b*. The sheet metal wall panel is illustrated at 13*a* or 13*b*.

FIG. 2*a* shows a combination in which a flat sheet metal panel 13*a* is attached to corner posts 12*a* which are of I-beam cross-section.

FIG. 2*b* illustrates the case where a vertically corrugated sheet metal panel 13*b* is attached to a corner post 12*b* of heavy steel channel section.

In each case, the corner post 12*a* or 12*b* is of fairly substantial width, considered as measured laterally of the platform base. The platform base has a basic width which is indicated by the dimension B.

Reference to FIG. 5 shows the width constraints on a standard international freight container. The corner fittings or fitments are shown at 23 and must have a precise spacing so as to be compatible with other standard containers for stacking and transportation purposes. The overall maximum width is therefore designated by the letter W. Within the overall maximum width, it may be necessary to lash cargo down to the lashing hooks 20 as indicated diagrammatically at 24. This means that the maximum allowable width of the platform is reduced by a small amount L, representing the lashing gap, at each side of the platform. It is desirable for the surface of the platform to be as wide as possible, so as to support the maximum amount of cargo without overhanging the side rails 18. However in the conventional prior art flatrack of FIG. 1 and FIG. 2, it will be seen that the corner posts 12*a* and 12*b* have a width which is greater than the lashing gap L and therefore the basic width B of the prior art flatrack is reduced substantially from the theoretical maximum W minus 2L.

FIGS. 3 and 4 illustrate an embodiment of the present invention and can be compared directly to FIGS. 1 and 2 showing the prior art. Since most of the features of the flatrack are common, a similar series of reference numerals increased by 100 will be used where appropriate.

It will be seen that the walls 111 comprise laterally slender corner posts 112 which are of solid metal bar and which taper from a wide base 125 to a somewhat narrower top 126. The width of the slender post 112 is less than or equal to the lashing gap width L and may typically be between 15 mm and 40 mm in a preferred form although it may be larger. However the conventional corner post of the prior art container is usually between 100 and 200 mm, severely restricting the basic width B of the platform base. The comparable dimensions are illustrated diagrammatically in FIG. 4*a*.

When the wall is folded down onto the base, as shown at the left-hand end of FIG. 3, the slender side posts 112 lie alongside the side rails 118, within the conventional lashing gap L. This means that the side rails 118 can be spaced by an extended width E which is typically 140 mm wider than the basic width B of the conventional platform base. Taken over the length of the platform base, for example 6058 mm (20 ft) the extra available load carrying area is quite substantial.

Where longer platform bases are concerned, for example those of 12192 mm (40 ft.), it has previously been proposed to narrow the platform in the region where the posts lie when folded down, in order to gain the maximum platform width in the centre. The present invention enables the lashing gap to be retained substantially constant throughout the length of the flatrack.

In general, the function of the corner posts is to resist downward loading as shown by the arrow A, for example when loaded containers are stacked one on another. In order to do this, the slender side posts need to be braced so as to prevent them from buckling. Additionally, the corner posts require to resist end loads B on the walls, for example those encountered during sudden acceleration or deceleration of freight on a railway train during shunting, when a dead weight container is stacked on top of it. Such loads are also encountered by stacked containers on board ship. The slender corner posts are only slender in the direction considered laterally of the platform and have the tapered form shown in FIG. 3, so they are capable of resisting end loads satisfactorily. The third type of loading is that illustrated by the arrow C, namely side loads applied to the corner posts, for example during side-by-side stacking of containers in a freight yard. Again, the slender posts 112 need to be stiffened against possible buckling under such side loads.

FIGS. 4*a* to 4*f* show various forms of wall. In each of these figures, the wall structure 113 is rigidly secured to the corner post 112 and the wall structure and corner posts combine synergetically to retain the structural integrity of the wall under any of the types of loading A, B or C.

Figure 4A:
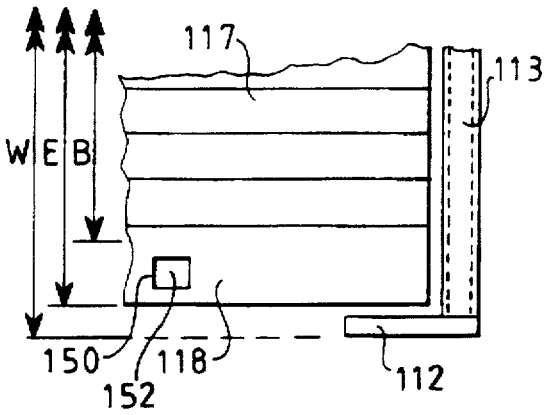

FIG. 4*a* shows a wall structure in the form of horizontally corrugated sheet metal. Although this is somewhat similar to the metal panel 13*b* shown in FIG. 1, the corrugations run horizontally as best seen in FIG. 3 of the drawings. Thus, the metal is particularly stiff in the horizontal direction and supports the slender end corner posts 112 against buckling either under top loading A or side loading C. As previously referred to, end loading B is applied in the plane of the slender corner posts 112 so the intervening wall structure 113 does not need to assist the corner posts in withstanding end loading.

Figure 4B:
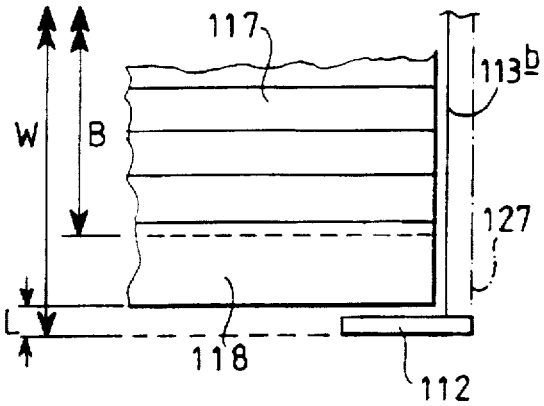
Figure 4C:
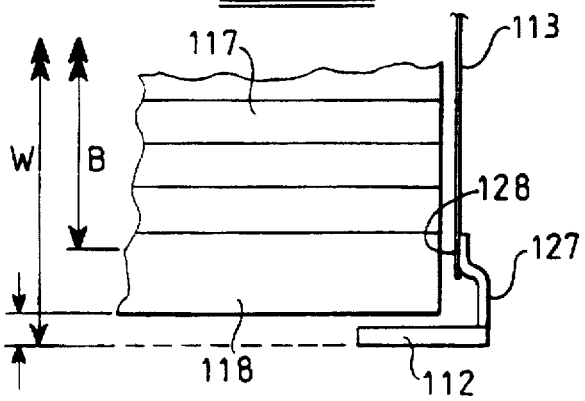

FIG. 4*b* of the drawings shows wall structure 113*b* comprising a flat plate. This may be reinforced by transverse members shown in chain-dotted outline at 127. Alternatively, the metal sheet may have a plurality of indentations, diagonal ribs, a honeycomb structure or may by some other means be stiffened to withstand side loads C. However even if not so stiffened, the wall structure 113*b* acts as a tie, holding the corner posts 112 in fixed spacing throughout their height, and hence preventing buckling due to downward loads exerted on the corner fitting 123. Normal downward loading on the corner fittings 123 will act slightly inside the side posts and will tend to buckle these outwardly, which is resisted by the sheet metal wall structure 113*b*, which acts as a tie between the slender posts 112.

Alternative features shown in the remaining parts of FIG. 4 illustrate further alternatives. FIG. 4*c* shows the use of a pressing 127 of cranked formation used to stabilise the slender side posts and to provide a larger area 128 by which the side posts can be welded to the wall structure generally referred to at 113 and of any of the previously discussed types.

Figure 4D:
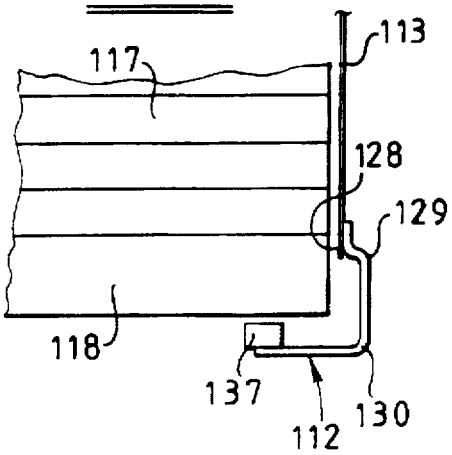

FIG. 4*d* shows an alternative in which the slender side post takes the form of a general angle section heavy metal pressing which again can be welded at 128 to the wall structure 113 but which is rendered stiffer by the pressed folds 129 and 130. If desired an additional rectangular cross-section bar 137 can be welded to the free edge of the side post for additional stiffness and rigidity.

Figure 4E:
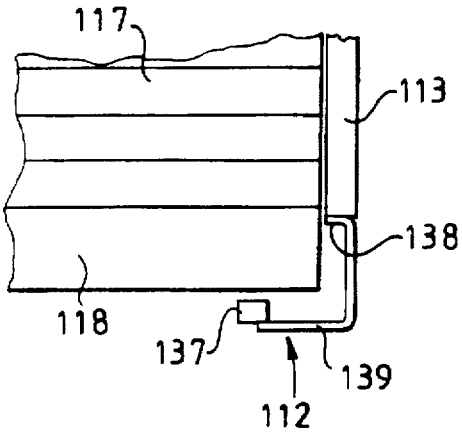

FIG. 4*e* shows a somewhat similar form in which the slender side post is formed from an asymmetrical channel section having a short limb 138 which can be welded onto a wall structure 113, in this case provided with corrugations or transversely extending stiffeners. The longer limb 139 of the asymmetrical channel forms the corner post proper and again has a rigid bar or tube 137 secured to its free edge for added stiffness.

Figure 4F:
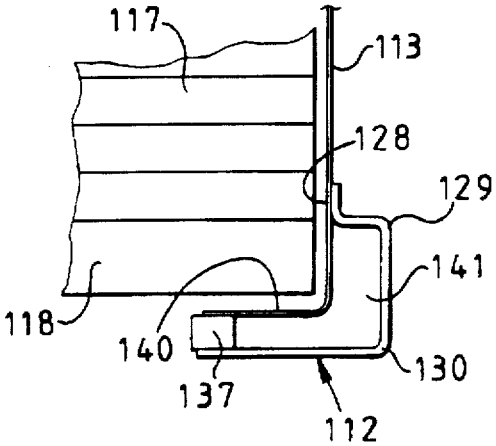

FIG. 4*f* shows the use of a pressing 140 which is of a similar shape to that shown in FIG. 4*d* and the same reference numerals have been used. However in this case, the sheet metal wall structure 113 is extended beyond the position of the weld 128 so as to come round the corner of the side rail 118 as shown at 140. It there forms a hollow box section 141 of generally L-shape considered externally, the stiffening bar 137 being welded both to the pressed corner post and to the extended sheet metal 113. The extension of the sheet metal wall structure may be integral or may comprise an additional metal extension welded on, the extension being of the same or different gauge.

FIG. 7 shows a post of this general type in use in the lowered condition of the wall. It will be seen that the hollow L-shaped box section, generally indicated at 141, sits on top of the side rails 118 and is contiguous with the panel 113 to provide a continuous load carrying surface.

Other embodiments may be possible within the scope of the invention.

Referring back to FIG. 3 of the drawings, it will be seen that the platform base 110 has, in its side rails 118, a pair of apertures 121 to receive handling equipment. These apertures 121 must be accessible when the walls are folded down. In the corner post shown at the right-hand side of the figure, cut-outs 142 are provided in the corner post so that, when the wall is folded down, the apertures 121 are visible. An alternative is shown at the left-hand end of FIG. 3 and in more detail in FIG. 6 of the drawings. The edge of the slender corner post, which may be reinforced by a bar 137, is formed with a notch or undulation 143 which fully reveals the aperture 121 when the walls have been folded down.

Alternatively, the tapering of the post 112 from a wide part, (not necessarily at the bottom) to a narrow part 126 at the top may allow sufficient space underneath the folded post 112 to allow free access to aperture 122 without the need for notches 143.

The transversely corrugated wall structure 113 rests on its corrugations on the decking 117 of the flatrack.

A further cut-out 144 may be provided coinciding with one of the depressions of the corrugated sheet metal wall structure 113, in order to receive lashings 145 of a load 146 as illustrated in FIG. 6. If desired, the entire edge of the post could be shaped to conform with the shape of the corrugated sheet metal which could then be welded on the rearwardly facing undulating surface of the corner post.

Cut outs 144 and the pitch of the corrugations (if any) in the sheet metal wall structure may be made wider and deeper to accommodate the forks of a fork lift truck, so that the forks may enter the apertures 144 under the load 146 without scraping the wall 113, post 112 or load 146, causing possible damage to these things.

The load could alternatively be supported clear of the peaks of the corrugations of the wall structure by timber members of slightly deeper depth than the corrugations, located in the recesses of the corrugations so as to spread the load across the wall structure. These timber members may be captivated in the corrugations and retained at the ends by the corner posts. The timber members may form non-integral stiffeners for the wall structure.

FIG. 8 of the drawings illustrates an alternative use for the wall, in which it is permitted to pivot outboard of the platform base 110 to form a loading ramp. Because of the wider effective spacing of the slender side posts 112, it is possible to accommodate the wheel base of a vehicle 147 which may either be used for handling the load being loaded on the flatrack or may form cargo to be carried, for example excavator machinery.

The folding flatrack of the present invention may have other features in association with those described, for example torsional or other spring counterbalancing for the walls, removable walls or open walls. Where there is no requirement for a panel to be used as the wall structure 113 between the slender corner posts, then the wall structure may comprise only a top rail; a top rail and a bottom rail; or a plurality of cross rails. In a still alternative form, doors may be provided between the slender corner posts provided that these are capable of being rigidly secured as a wall structure to support synergetically the slender corner posts while the wall structure is in position. The doors may be hinged to the sill, platform base or corner posts or an upper cross rail. When folded, they can be arranged to rest on the platform base. Alternatively they may be removable from the flatrack. In FIGS. 1 and 2*a* there can be seen square aperture stake pockets 50 which are fixed to the side rail 18. It is common to have a variety of lashing features, bars, rings, shackle points and the like fixed stationary or movably to the side rails 18. The stake pocket 50 is an example of one known lashing feature. The overall size of the stake pocket 50 is typically less than 100 mm. Stake pockets 50 are in common use and in use stakes 51 typically of timber or steel are inserted into the stake pockets 50 to project vertically upward above the platform 10 in order to retain cargo on the platform 10 there being no side walls to the flatrack.

It is a distinct structural advantage to have the top 52 of the stake pocket 50 which supports the stake 51 substantially flush with the deck 17 of the platform 10. Yet to maximise space for cargo, the stake pockets 50 need to be as far apart as possible. This can cause a geometric conflict since the posts 12*a*, 12*b* when folded must either fold above the top 52 of stake pocket 50 or the top 52 must lie below the level of deck 17, or stake pocket 50 must lie inboard of basic width B of platform 10.

In the present invention, the platform 110 is of extended width seen in FIGS. 4*a* and 7, so it follows that the stake pockets 150 can be placed close more or less to the overall extended width E apart yet with top 152 substantially flush with deck 117 between posts 112 when folded.

I claim:

1. A folding flatrack comprising:

a platform base having a pair of sides and a pair of opposing ends;

a pair of spaced corner posts pivotally mounted to said base at one of said ends; and a wall structure rigidly secured to said posts and extending transversely across said platform base, said posts and said wall structure forming a wall assembly pivotable between a first, upright position wherein said posts are upright on said base, and a second, collapsed position wherein said posts lie alongside said base;

wherein said base has a usable width (E) and an overall width (W), which encompasses the outer extremities of said opposed corner posts, a lashing gap (L) defined between said overall width (W) and said usable width (E) and said lashing gap being disposed within the overall width extending along each side of said base;

wherein each of said posts has a transverse dimension which is less than said lashing gap, said posts lie within said lashing gap on each side of said base in the second, collapsed position;

each one of said post being of angle cross-section having a pair of limbs;

one of said limbs being aligned with and partially overlapping said wall structure;

said one limb being secured to said wall structure along the overlap and defining a wall buckling prevention means to prevent vertical and lateral buckling of said posts.

2. A flatrack according to claim 1 wherein limb of said means to prevent buckling is spaced from the wall structure and secured thereto with an additional leg extending at an angle from said limb.

3. A flatrack according to claim 1 wherein each one of said post is of asymmetrical channel section and said means to prevent buckling comprises a short limb of said channel section secured at right-angles to the general plane of the wall structure.

4. A flatrack according to claim 1 wherein each said post comprises a sheet metal pressing.

5. A flatrack according to claim 1 wherein each said post comprises a rolled steel section.

6. A flatrack according to claim 1 wherein each said post has a tapering configuration.

7. A flatrack according to claim 1 wherein each said post tapers from the hinge end to the free end.

8. A flatrack according to claim 1 wherein each said post has an aperture at one or more positions along its length.

9. A flatrack according to claim 8 wherein said platform base is provided with lifting apertures corresponding with the apertures of said post.

10. A flatrack according to claim 1 wherein each said post has one or more non-linear edges.

11. A flatrack according to claim 1 wherein said platform base is provided with lifting apertures.

12. A flatrack according to claim 1 wherein the wall structure has generally right angled edge extensions which are secured to the limbs of said posts.

13. A flatrack according to claim 12 wherein the wall structure has edge extensions which are secured parallel to form a hollow tubular structure with each post.

14. A flatrack according to claim 12 wherein the wall structure has edge extensions which are secured side-by-side as a laminate with each post.

15. A flatrack according to claim 1 wherein the folding wall is arranged to fold outboard of said base to form a loading ramp.

16. A flatrack according to claim 1 wherein the wall structure comprises a metal sheet and includes stiffeners associated with said wall effective against loading applied transversely of the platform.

17. A flatrack according to claim 16 wherein said stiffeners comprise one or more transverse beams.

18. A flatrack according to claim 16 wherein said stiffeners are effective against vertical loading.

19. A flatrack according to claim 16 wherein said stiffeners are integrally formed in the metal sheet of the wall structure.

20. A flatrack according to claim 16 wherein said stiffeners are rigidly secured to the metal sheet of the wall structure.

21. A flatrack according to claim 1 wherein the posts have a dimension transversely of the platform of less than 100 mm.

22. A flatrack according to claim 21 wherein the posts have a dimension transversely of the platform of between 15 and 40 mm.

23. A flatrack according to claim 1 wherein each said post has a rectangular cross-section.

24. A flatrack according to claim 1 wherein said lashing gap remain of substantially constant width throughout the length of said platform base.

25. A flatrack according to claim 1 wherein said flatrack has a length in excess of 6058 mm. (20 ft.).

* * * * *